US006175971B1

(12) United States Patent
O'Neill

(10) Patent No.: US 6,175,971 B1
(45) Date of Patent: Jan. 23, 2001

(54) SHOWER DRAIN

(75) Inventor: Michael O'Neill, 4515 W. McLaren, Seattle, WA (US) 98199

(73) Assignee: Michael O'Neill, Seattle, WA (US)

( * ) Notice: Under 35 U.S.C. 154(b), the term of this patent shall be extended for 0 days.

(21) Appl. No.: 09/253,324

(22) Filed: Feb. 19, 1999

(51) Int. Cl.[7] ..... E03C 1/26
(52) U.S. Cl. ..... 4/613; 4/288
(58) Field of Search ..... 4/286, 288, 613, 4/650, 652, DIG. 4; 241/46.015

(56) References Cited

U.S. PATENT DOCUMENTS 2,819,915 * 1/1958 Woodson ..... 241/46.015 X
2,860,836 * 11/1958 Jordan ..... 4/288 X
3,327,326 * 6/1967 Friedman ..... 4/286

* cited by examiner

*Primary Examiner*—Robert M. Fetsuga
(74) *Attorney, Agent, or Firm*—Christensen O'Connor Johnson Kindness PLLC

(57) ABSTRACT

A shower drain assembly (10) is provided for use with a shower having a base drain opening. The drain assembly includes a drain fitting (12), an annular pressure plate (26), and an annular collar (28). The drain fitting has an upper lateral flange (14) and an upright cylindrical portion (16) extending downward from the underside of the flange. The cylindrical portion includes a number of shelves (18) extending laterally. Spaces (19) are available between shelves. The annular collar (28) includes an inner diameter with a number of ribs (30) extending laterally inward from the collar inner diameter surface. The collar also includes a number of holes (34), each hole being adapted to engage a corresponding fastener (32). During use, the drain fitting is inserted downward through the drain hole and is stopped by the flange; the pressure plate and collar are slipped upward around the drain fitting cylindrical portion, with the ribs passing through the cylindrical portion spaces; the collar is rotated so that the bottom of the ribs rest against the upper surface of the shelves; the fasteners are inserted upward into the holes and are made to create an upward force on the pressure plate and a downward force on the collar. The collar ribs engage the shelves and thereby pull the fitting downward against the shower.

16 Claims, 5 Drawing Sheets

SHOWER DRAIN

FIELD OF THE INVENTION

The present invention relates to discharge drain assemblies, and more particularly, to a shower drain assembly for use in the base of a shower as a transition piece from the shower to a drain pipe.

BACKGROUND OF THE INVENTION

In the construction industry, shower drain assemblies are used to connect the base of a shower with an outgoing drain pipe. In both new construction and remodel projects, a first worker typically inserts a drain fitting downward into a pre-existing shower base drain hole. A second worker, located beneath the floor supporting the shower, e.g., in a basement or crawl space, attaches additional assembly pieces to the fitting to seal it against the shower base underside surface and/or surrounding structure. It is usually necessary for the first worker to hold the drain fitting steady from above while the second worker attaches the additional pieces from below.

U.S. Pat. No. 3,896,511 illustrates a typical arrangement in which a shower fitting 14 is inserted downward into an opening 11 in the base of a shower receptor 12. A discharge pipe 13 is connected to the fitting lower end. The fitting 14 includes a cylindrical body 16 having lateral threads about its exterior. Once the fitting is placed in the opening 11, a number of seal rings are placed from below up and around the cylindrical body. A nut 22 engages the body threads to secure the seal rings and fitting to the shower receptor 12. A flange 17 maintains the fitting in the shower receptor by providing a force on the shower base that opposes the force provided by the nut 22.

The device described in the '511 patent has a number of disadvantages, the most significant of which is that the '511 device can be difficult to seal. Rotation of the nut 22 against the seal rings tends to also rotate the seal rings and fitting which deters a good seal and further makes it difficult to tighten the nut. Further, a number of current drain assemblies are presently manufactured such that their threads are not perpendicular to their top flanges. This creates a situation in which the nut will tighten on one side or location, but not on the opposing side. This is a problem in that it leaves the uncontacted side unsealed and not in contact with the bottom of the shower base, thereby making a complete seal unattainable. Likewise, some of these current drains are manufactured such that the threading on the inside of the nut is not perpendicular as required.

Another problem with the '511 device is that it is annoying and time-consuming to install, since rotation of the nut 22 is not always easily accomplished. This is particularly true if the only access to the underside of the drain fitting is from a confined space in which the worker's arm and/or wrist cannot easily move to rotate and tighten the nut 22. In addition, this type of drain requires the additional person located above the drain fitting to hold the fitting in place while the first worker tightens the nut from below.

Although not applied to the shower drain art, U.S. Pat. No. 3,509,586 describes a sink strainer mounting means in which an annular carrier 16 is screwed to threads 8 on the exterior of a drain fitting lower outlet end 7. The carrier 16 includes three ears 20 extending laterally outward at locations spaced 120 degrees apart. Screws 22 are insertable through the ears 20 to provide an upward force to a pressure member 11. While this arrangement improves the operator's ability to effectuate a good sealing fit and further helps to reduce the frustration associated with screwing a large nut onto the fitting itself, the '586 arrangement still has the disadvantage of requiring the need to screw the carrier 16 onto the outlet end 7. This can still pose a problem in applications having restricted space.

U.S. Pat. No. 5,560,052 describes a garbage disposal assembly in which a cylindrical sink flange 60 is attached to a sink bottom 22 by screws 43 exerting an upward force on a backup ring 47. The sink flange includes an upper lip 82 that rests within the sink. The upward force of the mounting screws 43 is effectuated by inserting the mounting screws up through a mounting ring 42. The mounting ring 42 has restricted downward motion by abutting against a snap ring 50 attached around an inward ring groove 66 formed in the lower end of the sink flange 60. While this arrangement is easier to install, it is susceptible to damage and/or dysfunction should the snap ring 50 unseat from the sink flange 60 and/or become damaged.

Thus a need yet exists for an improved shower drain fitting that is easy to install even in confined spaces and that includes a robust means for being held in the base of a shower. The ideal assembly would further allow a single person to install the assembly and provide a good sealing fit. The present invention is directed to fulfilling these needs as well as others described below.

SUMMARY OF THE INVENTION

In accordance with aspects of the present invention, a shower drain assembly is provided for use with a shower base having a drain opening. The drain assembly includes a drain fitting, an annular pressure plate, and an annular collar. The drain fitting has an upper lateral flange and an upright cylindrical portion extending downward from the underside of the flange. The cylindrical portion includes a number of rigid shelves extending laterally thereabout, with upright spaces being available between shelves. The annular collar has an inner diameter with a number of ribs extending laterally inward from the inner diameter surface. The collar also includes a number of holes adapted to engage fasteners. During use, the drain fitting is inserted downward through the drain hole and is stopped by the flange. The pressure plate and collar are slipped upward around the drain fitting cylindrical portion, with the ribs passing through the cylindrical portion spaces. The collar is rotated so that the bottom of the ribs rest against the surface of the shelves. The fasteners are inserted into the holes and made to create an upward force on the pressure plate and a downward force on the collar. The collar ribs engage the shelves, thereby pulling the fitting downward.

In accordance with other aspects of this invention, the shelves include notches, each having a width at least as great as the width of its corresponding rib. In an alternative embodiment, each shelf is formed in an ascending staircase manner, with the various steps having a width sufficient to support a rib during use.

In accordance with further aspects of this invention, an alternative shower drain assembly is provided in which the drain fitting has an upright cylindrical portion with a lateral radial channel formed in its exterior surface. The cylindrical portion also includes a number of upright channels extending from the bottom edge of the cylindrical portion upward to the lateral channel. The lower wall of the lateral channel providing a number of shelves. During use, the drain fitting is inserted downward through the drain hole and is stopped by the flange. The pressure plate and collar are slipped upward around the drain fitting cylindrical portion, with the ribs passing through the upright channels. The collar is rotated so that the bottom of the ribs rest against the lower wall of the lateral channel. The fasteners are inserted into the holes and are made to create an upward force on the pressure plate and a downward force on the collar. The collar ribs engage the shelves, thereby pulling the fitting downward.

In accordance with still other aspects of this invention, an improvement to a shower drain fitting having an upper lateral flange and an cylindrical portion extending downward from the underside of the flange is provided. The improvement includes a number of channels formed in the cylindrical portion exterior surfaces the channels being formed as upside down "J" shapes. The improvement further includes an annular collar having an inner diameter with a number of ribs extending laterally inward from the inner diameter surface. The collar includes a number of holes, each being adapted to engage a fastener. During use, the collar is placed about the cylindrical portion with the collar ribs being engaged in the channels.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention is a discharge drain assembly for a shower receptacle. In general, each embodiment includes a collar that can be used to pull a main cylindrical fitting downward while simultaneously pushing a pressure plate and various seals upward. A number of embodiments of the present invention assembly, and particularly the engagement between the collar and fitting, are described below.

Figure 1:
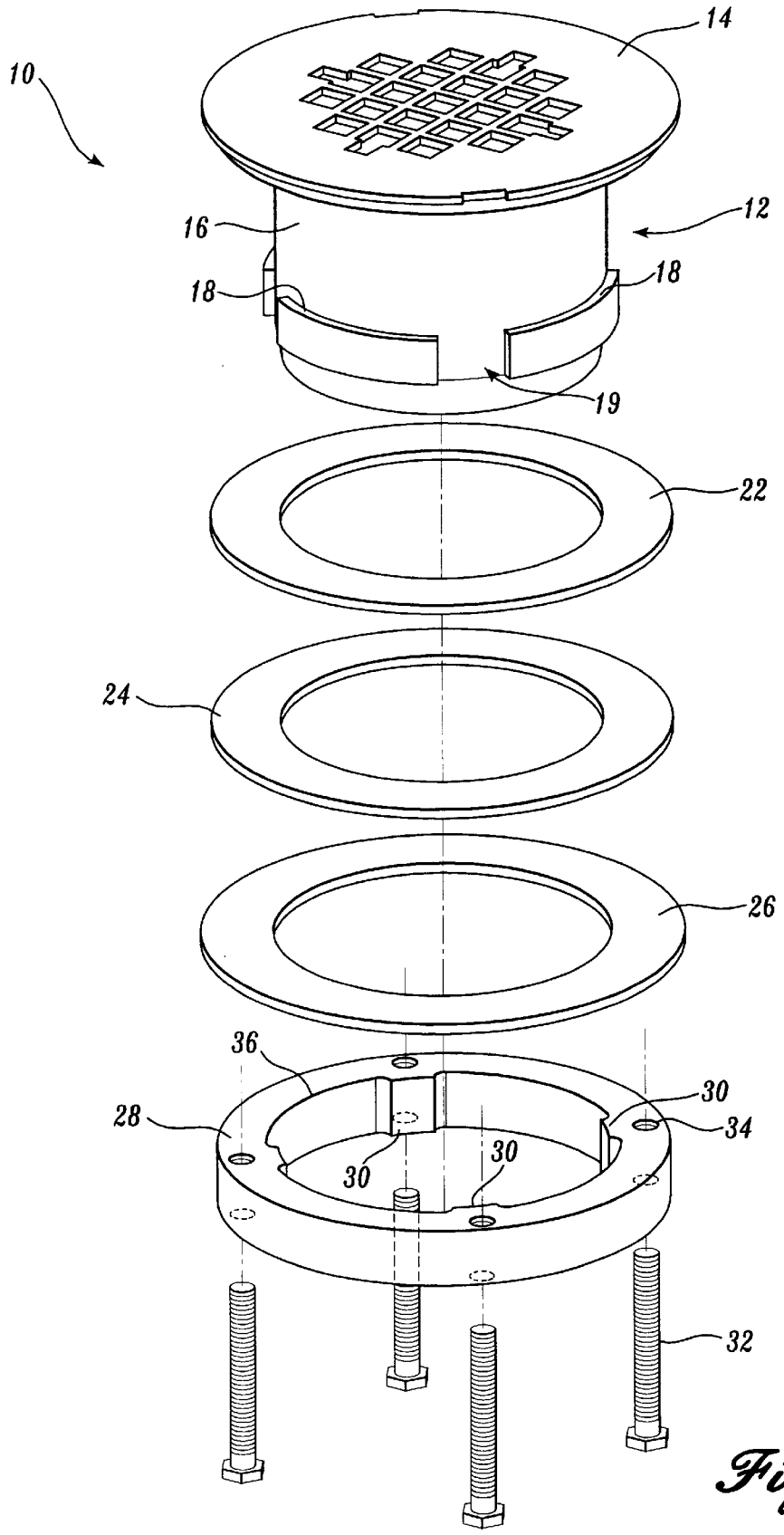
FIG. 1 is an exploded view of one embodiment of a discharge drain assembly formed in accordance with the present invention.
Figure 2:
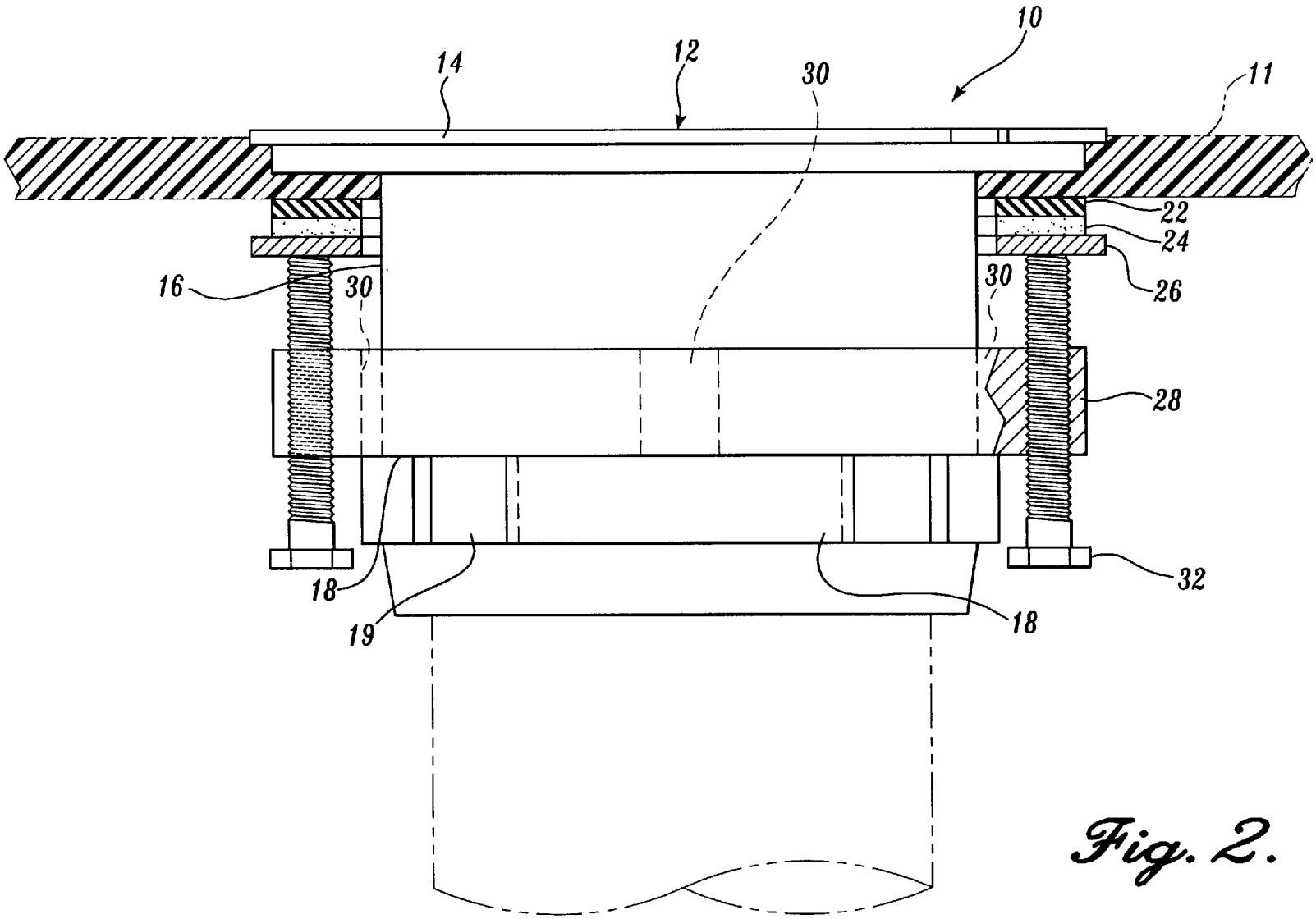
FIG. 2 is a partial cross sectional side view of the drain fitting of FIG. 1 as installed in a shower base drain opening.

Referring to the embodiment of FIGS. 1 and 2, the discharge drain assembly 10 includes a drain fitting 12 having an upper lateral flange 14 and an upright cylindrical portion 16 extending downward from the lower surface of the flange 14. Located about the exterior of the cylindrical portion 16 are a number of shelves 18. The shelves extend laterally outward a small distance from the cylindrical portion exterior surface. Spaces 19 are formed along the cylindrical portion at the locations between the shelf ends. The drain fitting 12 may be formed from any one of a number of known materials, e.g., brass, stainless steel, hard plastic (for example, PVC or ABS), etc. In preferred embodiments, the shelves are integrally formed with cylindrical portion. A number of seals are provided. A rubber seal 22 and a fiber seal 24 are provided in the embodiment shown in FIGS. 1 and 2. Other seals and seal materials may be used as appropriate for a given installation as is known in the art.

Still referring to FIGS. 1 and 2, the discharge drain assembly 10 includes a pressure plate 26 formed as a rigid annular disk. The pressure plate 26 is also formed from any one of a number of known rigid materials, e.g., brass, stainless steel, plastic, steel, etc. In one embodiment, the pressure plate 26 is of a thickness in the range of about 1/32 inch to about 1/4 inch, depending on the properties of the material used. The seals 22, 24 and the pressure plate 26 have an inner diameter that is sized to fit easily past the lower outer diameter of the fitting (i.e., the outer diameter of the cylindrical portion 16 itself plus the shelves 18). In one embodiment, the cylindrical portion has an outer diameter in the range of about 2 3/4 inches to about 3 1/8 inches, and shelves extending outward by an amount in the range of about 1/16 inch to about 1/4 inch. The combination of cylindrical portion and shelves are sized to fit through the shower base drain opening.

The drain assembly 10 further includes an annular collar 28 having an inner diameter 36 sized at least slightly larger than the largest outer diameter of the cylindrical portion 16 with the shelves 18. The annular collar 28 is formed from any one of a number of known materials, e.g., brass, stainless steel, hard plastic, etc. Positioned along the inner diameter 36 are a number of ribs 30 extending inward a short distance. The number of ribs is equal to or less than the number of spaces 19. In one embodiment; the annular collar inner diameter 36 is in the range of about 2 3/4 inches to about 3 1/8 inches, with the ribs extending inward a distance in the range of about 1/16 inch to about 1/4 inch. Threaded holes 34 are provided through the cross section of the collar, one preferably being provided at the location of each rib 30. The threaded holes 34 are adapted to receive corresponding bolts 32 during use. Other types of fastening arrangements may be used. In one embodiment, the fastener is a bolt with a hexagonal "nut-driver" head.

Referring particularly to FIGS. 1 and 2, to install the drain assembly, the drain fitting 12 is inserted downward into an opening in the base of a shower 11 from a location above the opening. The opening is sized large enough to allow through-passage of the cylindrical portion 16 and shelves 18, though not large enough to allow passage of the flange 14. The seals 22, 24 are slipped upward about the cylindrical portion 16 from below the fitting. The seals are eventually positioned adjacent to the undersurface of the shower 11.

The pressure plate 26 is also slipped upward about the cylindrical portion 16 from a location below the fitting and beneath the seals. The collar 28 is then inserted onto the cylindrical portion 16 by first positioning the collar ribs 30 at the location of the cylindrical portion spaces 19, moving the collar upward so that the ribs pass through the holes 19, and then rotating the collar 28 slightly so that the ribs 30 rest on the upper surface of the shelves 18. In this regard, the ribs sit on top of the upper surface of the shelves. In preferred embodiments, the ribs and shelves are sized similarly in lateral thickness so that there is sufficient contact between them and so that only shear forces are acting at the location of the ribs with the collar and the location of the shelves with the cylindrical portion. Bending moments at these locations should be avoided. It is generally beneficial for there to be at least three or four equally-spaced rib/shelf contacts between the collar and the cylindrical portion.

Screws 32 are threaded into the collar holes 34 from beneath the collar 28. To tighten the assembly, the screws 32 are rotated until the upper screw ends contact the pressure plate 26 and force the pressure plate upward. Eventually, the pressure plate contacts the underside of the shower base 11. When this happens, then further rotation of the screws causes a downward force on the shelves 18 at the location of contact between the collar ribs 30 and the shelves, and an upward force on the pressure plate 26. The downward force on the shelves' upper surfaces causes the drain fitting 12 to be pulled downward. The flange 14 stops the drain fitting from moving through the shower base. These forces also help to seal the drain fitting at the drain opening.

Figure 3:
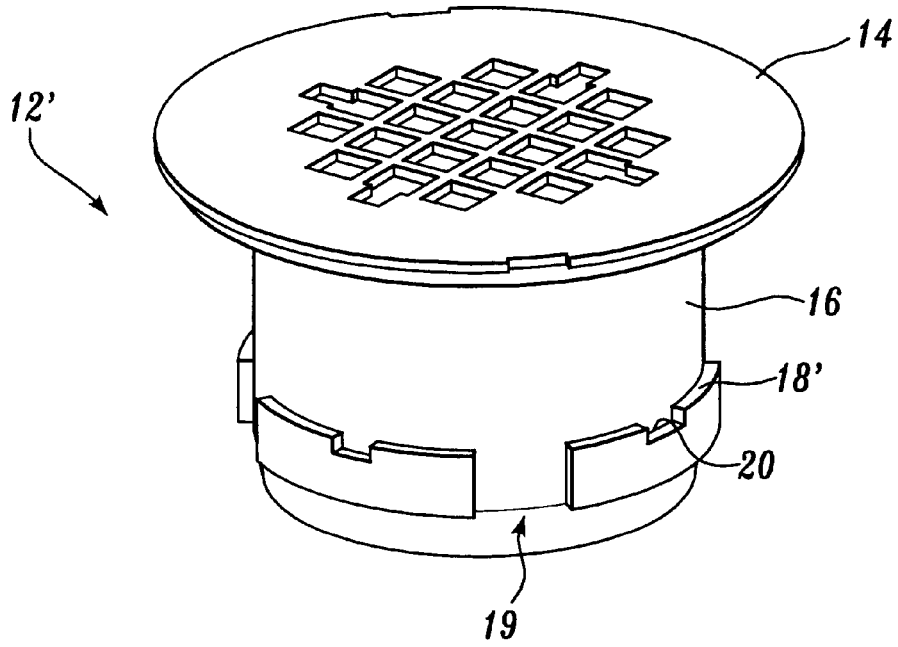
FIG. 3 is a perspective view of a second embodiment of a drain fitting formed in accordance with the present invention.

Various alternative arrangements of the present invention are possible, including those described with reference to FIGS. 3–7 and others. FIG. 3 illustrates an embodiment of a fitting 12 in which the shelves 18 include various notches 20 extending downward from their upper edges through a portion of the shelf The notches 20 are sized at least as large in width as the width of the ribs 30. This allows the ribs 30 to drop into the notches and be securely held there without risk of the collar 28 falling off should it be knocked inadvertently during assembly. If the ribs are kept at the location of the notches, the notches will also help prevent the fitting and collar from rotating during tightening of the screws.

Figure 4:
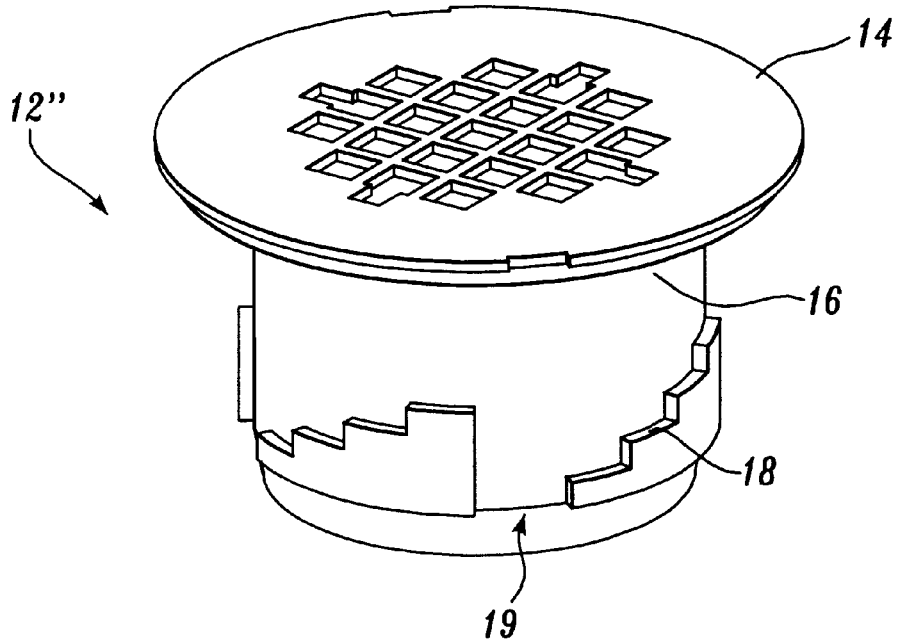
FIG. 4 is a perspective view of a third embodiment of a drain fitting formed in accordance with the present invention.

FIG. 4 illustrates an embodiment of a fitting 12 in which the shelves are formed with an upper edge being formed in an ascending staircase manner. This results in the shelf having a progressively increasing shelf height. This staircase arrangement enables the worker to use the present invention drain assembly in installations of various thicknesses. This embodiment further eliminates the need to use excessively long screws should the distance between the underside of the floor to the upper surface of the shelf be large. Instead, the user can simply position the collar on one of the higher steps.

Figure 5:
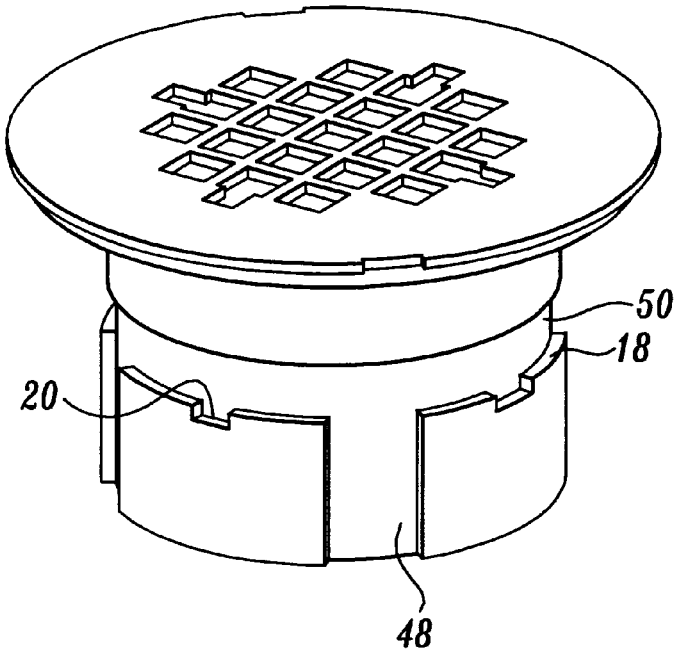
FIG. 5 is a perspective view of a fourth embodiment of a drain fitting formed in accordance with the present invention.
Figure 6:
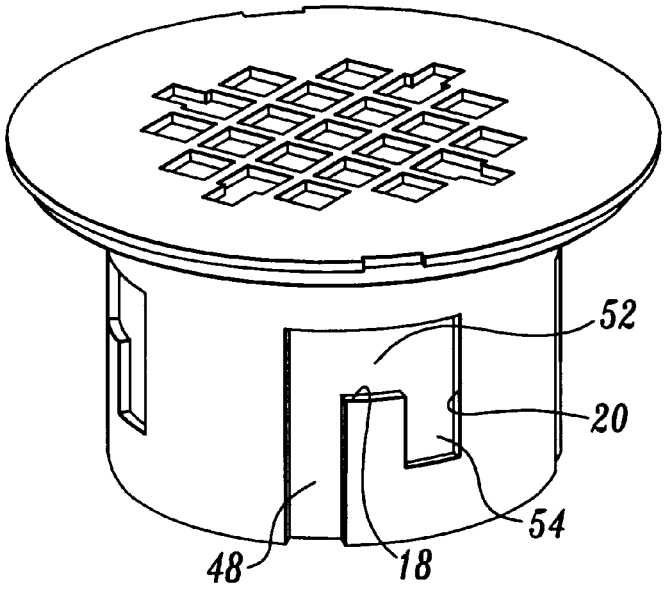
FIG. 6 is a perspective view of a fifth embodiment of a drain fitting formed in accordance with the present invention.

FIGS. 5 and 6 illustrate fourth and fifth embodiments of drain assembly fittings formed in accordance with the present invention in which the shelves have been formed in the fitting by boring out only select portions of the exterior surface of the cylindrical portion (or forming the fitting with select portions missing, as the case may be depending on the materials used.) In FIG. 5, upright channels 48 are formed by removing upright strips of the exterior of the cylindrical portion. A radial channel 50 is formed by removing a lateral strip from the cylindrical portion as well. During use, the ribs are passed upward through the upright channels and then moved laterally to rest upon the channel-formed shelves 18 (and/or in notches 20 if provided).

In FIG. 6, upright channels 48 are formed in the exterior of the cylindrical portion. The upright channels are connected to short lateral channel portions 52 which are followed by short downward channel portions 54 (similar to the notches 20 in function.) The combined channels appears as a square-shaped upside-down "J". During use, the ribs are passed upward through the upright channels 48 and then moved laterally in the short lateral channel portions 52 and finally dropped into the downward channel portions 54.

Figure 7:
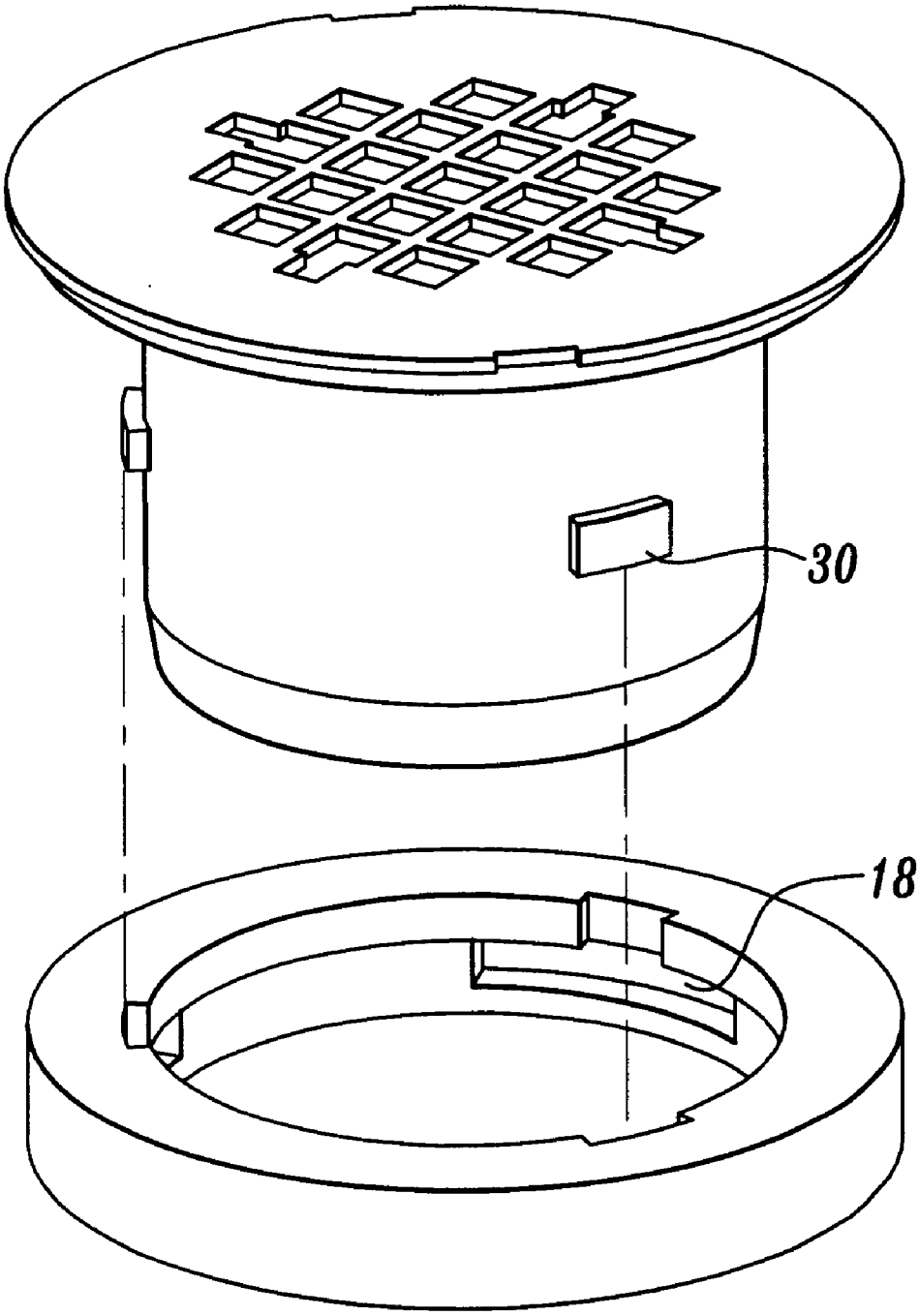
FIG. 7 is a perspective view of a sixth embodiment of a drain fitting and collar formed in accordance with the present invention.

The above arrangements provide engagement between the collar and the cylindrical portion by inserting collar ribs into portions of the cylindrical portion and then resting the ribs on shelves formed in the cylindrical portion. Alternatively, each of these arrangements may be made in the reverse where the cylindrical portion includes the ribs and the collar includes shelves upon which the ribs may rest. FIG. 7 illustrates one such arrangement.

It will be appreciated from a reading of the above, the present invention entirely eliminates the need to screw a large nut about a drain fitting. The assembly requires only a small rotation of the collar in order to position the ribs on the shelves and no rotation of the collar in order to tighten the drain assembly. Instead, the assembly is tightened by turning the screws 32. Space permitting, this can be accomplished with an automated drill, nut driver, or the like. The present invention simplifies installation by permitting a single worker to easily install the assembly without requiring aid from another, and allows the worker to obtain a good tight seal between the fitting and the shower. In addition, the contact between the ribs and the shelves is solid and not likely to break or unseat during use.

A further advantage of the present invention is its ability to adequately compensate for slight variations in the thickness of the shower receptacle base at the drain opening. The worker can increase sealing contact at a location of thin shower thickness by increasing the upward force on the pressure plate at that location. In this regard, it is preferable to use at least four separate pressure points (i.e., bolts and bolt holes) to allow the pressure plate to adjust to these discrepancies in shower base thickness.

While the preferred embodiment of the invention has been illustrated and described, it will be appreciated that various changes can be made therein without departing from the spirit and scope of the invention. For example, while there are four ribs and four screw holes shown, other numbers may used. It is important for a good seal, however, that there be at least two screws and preferable that all screws be positioned equal-distance about the collar.

The embodiments of the invention in which an exclusive property or privilege is claimed are defined as follows:

1. A shower drain assembly for use with a shower base having a drain opening, the drain assembly comprising:

(a) a drain fitting having an upper lateral flange and an upright cylindrical portion extending downward from the underside of the flange; the cylindrical portion including a number of rigid shelves extending laterally about the cylindrical portion, upright spaces being available between shelves; wherein the shelves include notches each having a width at least as great as the width of its corresponding rib;

(b) an annular pressure plate; and (c) an annular collar having an inner diameter with a number of ribs extending laterally inward from the inner diameter surface; the collar including a number of holes, each being adapted to engage a fastener;

wherein during use, the drain fitting is inserted downward through the drain hole and is stopped by the flange; the pressure plate and collar are slipped upward around the drain fitting cylindrical portion, with the ribs passing through the cylindrical portion spaces; the collar is rotated so that the bottom of the ribs rest within the notches; the fasteners are inserted into the holes and made to create an upward force on the pressure plate and a downward force on the collar; the collar ribs engaging the shelves and thereby pulling the fitting downward.

2. The shower drain assembly formed according to claim 1, wherein the cylindrical portion and shelves are integrally formed of hard plastic.

3. The shower drain assembly formed according to claim 1, wherein the cylindrical portion and shelves are integrally formed of brass.

4. The shower drain assembly formed according to claim 1, wherein the pressure plate is formed from one of a hard plastic, brass, stainless steel, or steel.

5. The shower drain assembly formed according to claim 1, wherein the collar is formed from a hard plastic, brass, stainless steel, or steel.

6. The shower drain assembly formed according to claim 1, wherein the collar includes four ribs spaced equally about the collar inner diameter; and wherein the collar includes four threaded screw holes, one hole being located through the collar at each rib, the fasteners being bolts that engage the screw holes.

7. The shower drain assembly formed according to claim 1, wherein the collar includes four ribs spaced equally about the collar inner diameter.

8. The shower drain assembly formed according to claim 7, wherein the collar includes four threaded screw holes, one hole being located through the collar at each rib.

9. The shower drain assembly formed according to claim 1, wherein the shelves are formed by eliminating portions from the cylindrical portion to form a lateral channel, the notches being located in lower channel surfaces; and wherein the spaces are upright channels formed by eliminating portions from the bottom edge of the cylindrical portion upward to the lateral channel.

10. The shower drain assembly formed according to claim 9, wherein the cylindrical portion and shelves are integrally formed of hard plastic.

11. The shower drain assembly formed according to claim 9, wherein the cylindrical portion and shelves are integrally formed of brass.

12. The shower drain assembly formed according to claim 9, wherein the pressure plate is formed from one of a hard plastic, brass, stainless steel, or steel.

13. The shower drain assembly formed according to claim 9, wherein the collar is formed from a hard plastic, brass, stainless steel, or steel.

14. The shower drain assembly formed according to claim 9, wherein the collar includes four ribs spaced equally about the collar inner diameter; and wherein the collar includes four threaded screw holes, one holes being located through the collar at each rib, the fasteners being bolts that engage the screw holes.

15. The shower drain assembly formed according to claim 9, wherein the collar includes four ribs spaced equally about the collar inner diameter.

16. The shower drain assembly formed according to claim 15, wherein the collar includes four threaded screw holes, one holes being located through the collar at each rib.

* * * * *

UNITED STATES PATENT AND TRADEMARK OFFICE

CERTIFICATE OF CORRECTION

PATENT NO. : 6,175,971 B1
DATED : January 23, 2001
INVENTOR(S) : M. O'Neill

It is certified that error appears in the above-identified patent and that said Letters Patent is hereby corrected as shown below:

Title page,
Item [56], column 1, References Cited (U.S. Patents), insert in appropriate numerical order the following:

| | | | |
|---|---|---|---|
| -- | 2,225,693 | 12/1940 | Frances |
| | 3,104,400 | 9/1963 | Lantz et al. |
| | 3,509,586 | 5/1970 | Politz |
| | 3,896,511 | 7/1975 | Cuschera |
| | 5,560,052 | 10/1996 | Ferguson et al. -- |

Signed and Sealed this

Sixteenth Day of October, 2001

*Attest:*

Nicholas P. Godici

*Attesting Officer*

NICHOLAS P. GODICI
*Acting Director of the United States Patent and Trademark Office*